US005163597A

United States Patent [19]

Napoli, Jr. et al.

[11] Patent Number: 5,163,597

[45] Date of Patent: Nov. 17, 1992

[54] STAPLE INSTALLING AND REMOVING TOOL

[76] Inventors: Joseph Napoli, Jr., 24220 Nottingham Ct., Valencia, Calif. 91355; Patrick L. Dalton, 130 Lear Cir., Thousand Oaks, Calif. 91360

[21] Appl. No.: 775,459

[22] Filed: Oct. 15, 1991

[51] Int. Cl.[5] ..... B25C 1/02

[52] U.S. Cl. ..... 227/140; 227/147; 227/149; 254/28

[58] Field of Search ..... 227/140, 147, 149; 173/90, 91; 254/28

[56] References Cited

U.S. PATENT DOCUMENTS

| | | | |
|---|---|---|---|
| 337,212 | 3/1886 | Van Dusen | 227/140 |
| 985,135 | 2/1911 | Bigelow | 254/28 |
| 1,158,430 | 11/1915 | Bell | 227/147 |
| 2,199,833 | 5/1940 | Fleischman | 227/149 |
| 3,036,482 | 5/1962 | Kenworthy et al. | 227/149 |
| 3,934,779 | 1/1976 | Dent | 227/149 |

*Primary Examiner*—Douglas D. Watts
*Assistant Examiner*—Allan M. Schrock
*Attorney, Agent, or Firm*—Jack C. Munro

[57] ABSTRACT

A tool for installing and removing a staple comprising an elongated body which has an installing head at one end and a base at the opposite end. In between the head and the base is mounted a graspable handle which is to be slideable to exert a hammering force on a collar which is mounted on the body. This collar is to be adjustable longitudinally on the body to any desired position that will be convenient to the user. The head of the tool includes a staple removing device which is to be connected to a staple to effect removal thereof after it has been installed.

6 Claims, 1 Drawing Sheet

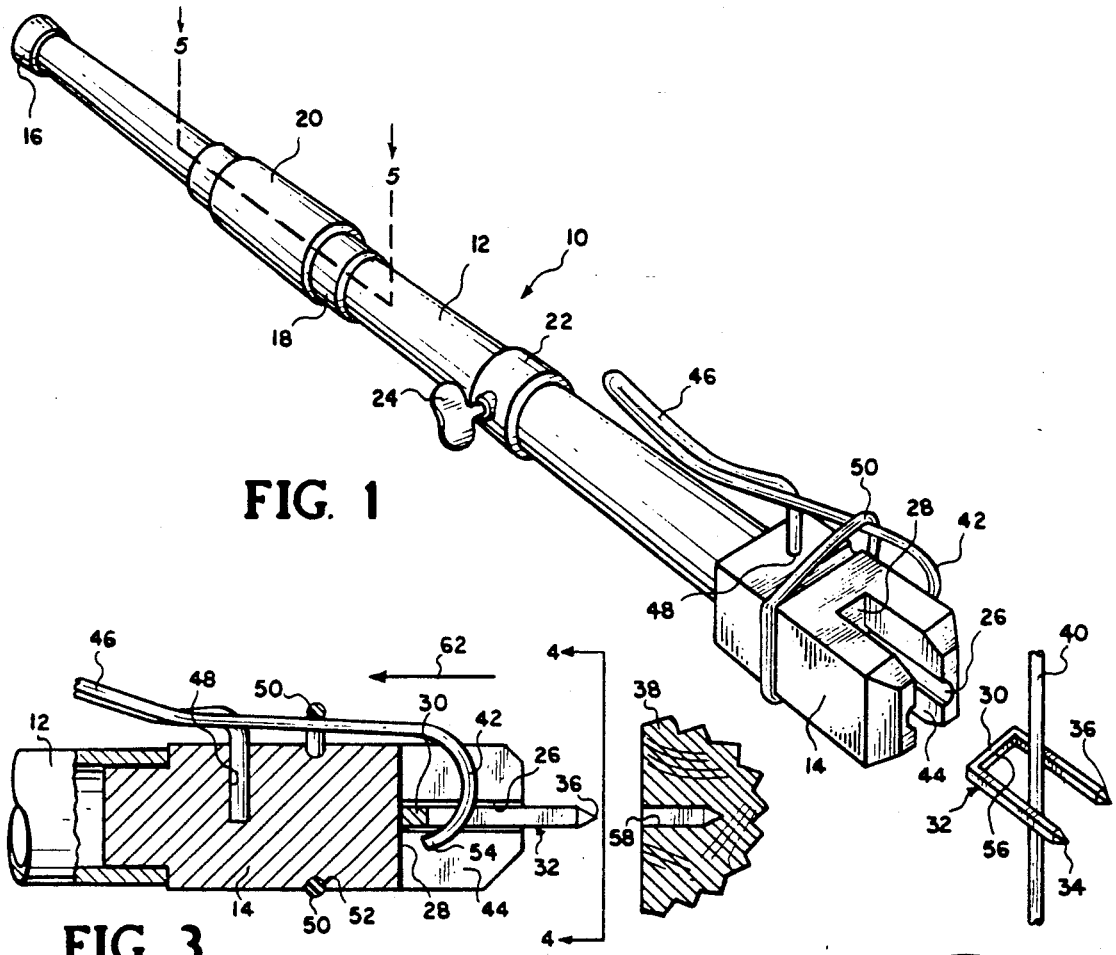
FIG. 1
FIG. 3
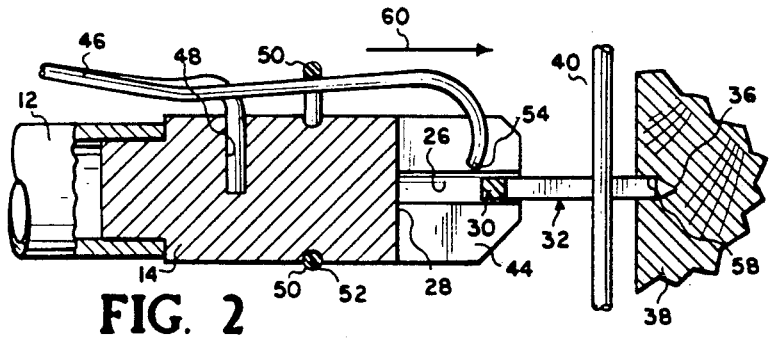
FIG. 2
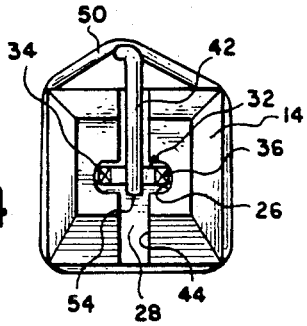
FIG. 4
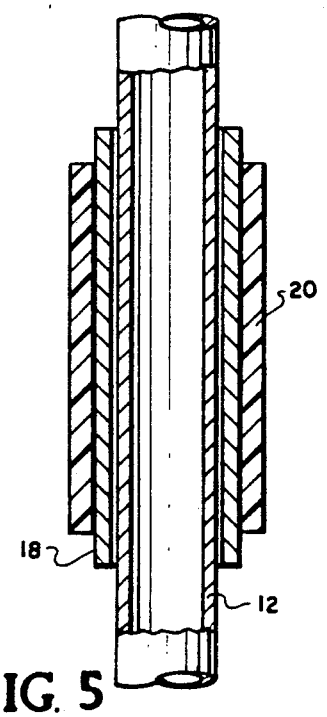
FIG. 5

STAPLE INSTALLING AND REMOVING TOOL

BACKGROUND OF THE INVENTION

1) Field of the Invention the field of this invention relates in particular to tools and more particularly to a tool which is to be useable to penetratingly install a staple within an exterior structure constructed of a penetrating material and also to a tool which can be used to effect removal of that staple once it has been installed.

2) Description of Prior Art

The use of U-shaped staples as fasteners is well known. A common use for such staples is to install an electric light cord in a fixed position on a structure such as the exterior of a house. Also, such light cords are commonly fixed in position with the interior of houses, office buildings and other similar types of structures. Also, staples are commonly used for attachments other than for electrical cords.

Frequently, the installation of the staple is in an inaccessible location. A typical inaccessible location would be along the eaves of a home or some other elevated position that is not readily accessible to people. In the past it has been known to utilize an elongated staple-installing tool where staples are to be placed at the outer end of the tool and an electrical cord be placed between the legs of the staple and the staple located at the desired position ready for installation. Installation is caused by hammering at the base of the tool which will cause the staple to be installed and the electrical cord held at this location.

It is common for the installation of such staples to be temporary and after a short period of time the staple is removed. For the removing of the staple the elongated tool that was used for the installation can not assist in that removal. Therefore, the removal is not easily accomplished with the usage of a ladder being required and the time procedure for removal being quite lengthy. There is a need to construct a tool to not only facilitate the installation of the staples but to also facilitate removal of the staples.

SUMMARY OF THE INVENTION

The tool of the present invention comprises an elongated body which terminates in an installing head at one end and a base at the opposite end. On the elongated body is mounted a collar, with this collar being adjustable on the body to any desired position. In between the collar and the base is mounted a slideable handle. The slideable handle is to be manually moved with a striking force into the collar which in turn causes a staple, which is located within a slot in the installing head, to penetrate an exterior structure and thereby be installed. The installing head also has mounted thereon a latching member, with this latching member being pivotable on the installing head between the position engaging with the slot and a position being spaced from the slot. With the latching member spaced from the slot, the installing head is to be used to install staples. When the latching member connects with the slot, the latching head is to latchingly connect with the apex portion of the staple, and upon exerting an outward force of sufficient magnitude, the staple will be removed.

The primary objective of the present invention is to construct a tool for installing staples in inaccessible locations and also the same tool can be utilized to conveniently remove staples from the same inaccessible locations.

Another objective of the present invention is to construct a tool which is constructed of few parts and therefore can be manufactured at a relatively low expense and therefore sold to the ultimate consumer at a low expense.

Another objective of the present invention is to construct a tool which can be manufactured in various lengths and can be utilized by even the most unskilled individual to install and remove staples from inaccessible locations.

BRIEF DESCRIPTION OF THE DRAWING

FIG. 1 is a isometric view of the tool of the present invention showing the position of the tool for installing staples;

FIG. 2 is a cross-sectional view through the installing head of the tool of the present invention showing the staple-removing device in the position connecting with the staple locating slot of the installing head and with the staple-removing device in the upper position as the installing head is in the process of connecting with an already installed staple;

FIG. 3 is a view similar to FIG. 2 but showing the staple-removing device in the lower position which is ready to be used to effect removal of the staple;

FIG. 4 is an end view of the installing head of the tool of the present invention taken along line 4—4 of FIG. 3; and FIG. 5 is a cross-sectional view through the graspable handle portion of the tool of the present invention taken along line 5—5 of FIG. 1.

DETAILED DESCRIPTION OF THE SHOWN EMBODIMENT

Referring particularly to the drawing there is shown the tool 10 of this invention which is composed of an elongated tubular (generally cylindrical) body 12 which terminates at one end in an installing head 14 and at the opposite end in a base 16. The base 16 generally comprises no more than a cap which prevents complete removal of a sleeve 18 which is low frictionally slidingly mounted on the body 12. Mounted on the sleeve 18 is a soft resilient annular pad 20. The pad 20 will be adhesively secured or otherwise permanently secured onto the sleeve 18. The pad 20 is to be grasped by hand of user (not shown) with motion imparted to the sleeve 18 to slide such on the body 12. The upper end of the sleeve 18 is to contact a collar 22. This collar 22 is to be fixed in position on the body 12 by means of a wing nut fastener 24. This fastener 24 is threadably mounted within the collar 22 and this fastener 24 is to have an outer end which is movable into tight contact with the body 12 thereby fixing in position the collar 22 to the body 12.

The collar 22 can be moved to any desired longitudinal position on the body 12 and generally the collar 22 will be moved so as to be located nearer the base 16 than the installing head 14. Many times the length of the body 12 will be eight, ten or twelve feet in length. For the installer to be able to manually move the sleeve 18 into contact with the collar 22, the collar 22 must be in close proximity to the user and it is for this reason that collar 22 is located generally near base 16.

The pad 20 will be adhesively secured or otherwise permanently secured onto the sleeve 18. The installing head 14 includes a horizontal slot 26. Slot 26 is open ended but is closed at its back end by a wall 28. The apex section 30 of the staple 32 is to be placed against the wall 28 with the staple 32 being located within the slot 26 and the sharp pointed ends 34 and 36 of the staple 32 protruding exteriorly of the slot 26. Therefore, when the user moves sleeve 18 abruptly into contact with collar 22, resembling a hammer type of action, a force is transmitted through the wall 28 to the staple 32 which will cause the sharp pointed ends 34 and 36 to penetrate a wood type of exterior structure 38. Once the staple 32 is so installed, the tool 10 is to be removed and the staple 32 will then be used to hold an object in place such as an electrical cord 40.

During the time that the staple 32 is being installed in position, there is a latching hook 42 which is placed against a sidewall of the installing head 14 and spaced from a vertical slot 44. This places the latching hook 42 in a position so as to not interfere with the installing procedure of the staple 32. The latching hook 42 is integrally connected to U-shaped end 46 which is pivotally mounted within hole 48 formed within the installing head 14. Therefore, movement of the latching hook 42 from the position shown in FIG. 1 to the position shown in FIGS. 2 to 4 of the drawing will result in a slight pivoting occurring between end 46 and the hole 48.

The latching hook 42 has a resilient O-ring 50 mounted about the latching hook 42 and the installing head 14. This resilient O-ring 50 is locatable within a groove 52 formed within the body of the installing head 14. It is the function of the groove 52 to hold in place the O-ring 50 relative to the installing head 14. The O-ring 50 exerts a continuous bias on the latching hook 42 tending to locate the latching hook 42 in a lower position as is clearly shown in FIG. 3 of the drawing. In this position the outer free end of the latching hook 42, which includes the cam surface 54, connects with the slot 26.

Let it now be assumed that the user wishes to use the tool 10 to remove a staple 32 from the exterior structure 38. The user physically removes the latching hook 42 from the location against the side of installing head 14 into slot 44 at which time the bias of the resilient O-ring 50 will move the latching hook 42 to the position shown in FIG. 3. The user then proceeds to place the slot 26 in connection with the apex section 30 of the staple 32 and as the staple 32 is moved along the slot 26 (in the direction of arrow 60), it will come into contact with the cam surface 54. This connection with the cam surface 54 raises the latching hook 42 to an upper position against the bias of the O-ring 50 with this position being clearly shown in FIG. 2 of the drawing.

As the apex end 30 of the staple 32 continues to move within the slot 26, the latching hook 42 will slip into the gap area 56 of the staple 32 and the latching hook 42 assumes the position shown in FIG. 3. At this time the user then exerts a pulling or outward force (in the direction of arrow 62) on the body 12 with this force being transfered through the latching hook 42 to the staple 32 and, if this force is sufficient, the staple 32 will be removed from its hole 58 formed within the exterior structure 38. The staple 32 is to be manually removed from the tool 10 prior to the tool 10 being reused to effect removal of another staple 32.

What is claimed:

1. A tool for installing and removing a staple comprising:

an elongated body terminating in a head at one end and a base at the opposite end, said head having an open-ended slot, a staple locatable within said open-ended slot with a portion of the staple protruding exteriorly of said slot; and staple connection means permanently mounted on said head, said staple connection means being movable between a staple installing position with said staple connection means being spaced from said open ended slot, and a staple removing position with said staple connection means engaging with said open-ended slot.

2. The tool as defined in claim 1 wherein:

said staple connection means being pivotally mounted on said head permitting pivoting of said staple connection means from said slot to a position spaced from said slot.

3. The tool as defined in claim 1 wherein:

said staple connection means being further movable within said slot between a first position and a second position, with said staple connection means in said first position a staple is insertable within said slot, with said staple connection means in said second position said staple connection means being capable of latching onto the staple by latching means and upon said body incurring an outward pulling force of sufficient magnitude the staple will be removed from the exterior object which it has penetrated.

4. The tool as defined in claim 3 wherein:

said latching means comprising a hook, said hook being able to latch onto the staple, said hook having an exterior surface, said exterior surface functioning as a cam surface and when contacted by the staple is moved from said second position to said first position.

5. The tool as defined in claim 4 wherein:

spring means connecting with said hook, said spring means exerting a continuous bias on said hook tending to locate said staple connection means in said second position.

6. The total as defined in claim 5 wherein:

said spring means comprising as resilient O-ring mounted around said hook and said head.

* * * * *